US007741259B2

(12) United States Patent
da Costa

(10) Patent No.: US 7,741,259 B2
(45) Date of Patent: Jun. 22, 2010

(54) ENVIRONMENTALLY COMPATIBLE HYDRAULIC FLUID

(75) Inventor: Daniel M. da Costa, Lake Worth, FL (US)

(73) Assignee: EnBio Industries, Inc., Lake Worth, FL (US)

( * ) Notice: Subject to any disclaimer, the term of this patent is extended or adjusted under 35 U.S.C. 154(b) by 1057 days.

(21) Appl. No.: 11/414,690

(22) Filed: Apr. 28, 2006

(65) Prior Publication Data

US 2007/0004606 A1 Jan. 4, 2007

Related U.S. Application Data

(60) Provisional application No. 60/696,060, filed on Jul. 1, 2005.

(51) Int. Cl.
*C10M 107/34* (2006.01)
*C10M 169/04* (2006.01)
*C10M 137/04* (2006.01)

(52) U.S. Cl. ..... 508/579; 508/110; 508/429

(58) Field of Classification Search ..... 508/579, 508/110, 431

See application file for complete search history.

(56) References Cited

U.S. PATENT DOCUMENTS

| | | | | |
|---|---|---|---|---|
| 2,558,030 | A | 6/1951 | Zisman et al. | |
| 4,434,066 | A | 2/1984 | Lewis | |
| 4,491,526 | A | 1/1985 | Deck | |
| 4,636,321 | A | 1/1987 | Kipp et al. | |
| 4,770,803 | A * | 9/1988 | Forsberg | 252/75 |
| 4,853,140 | A * | 8/1989 | Payne et al. | 508/164 |
| 5,342,531 | A | 8/1994 | Walters et al. | |
| 5,569,644 | A | 10/1996 | Geibach et al. | |
| 6,127,324 | A | 10/2000 | Tolfa et al. | |
| 6,436,883 | B1 * | 8/2002 | Nieh | 508/579 |
| 6,855,676 | B2 | 2/2005 | Li et al. | |
| 7,456,138 | B2 * | 11/2008 | Sherman et al. | 508/579 |
| 2005/0020457 | A1 | 1/2005 | Rohrbach et al. | |
| 2005/0250654 | A1 * | 11/2005 | Randles et al. | 508/279 |

FOREIGN PATENT DOCUMENTS

| | | | |
|---|---|---|---|
| DE | 2139892 | A1 | 3/1972 |
| DE | 4404804 | A1 | 8/1995 |
| EP | 0273460 | A | 7/1988 |
| EP | 0367011 | A | 5/1990 |
| GB | 610505 | A | 10/1948 |
| GB | 1199693 | A | 7/1970 |
| WO | WO 2004/007651 | A | 1/2004 |

OTHER PUBLICATIONS

Clariant GmbH, "Polyalkylene/Polyethylene Glycols", Clariant GmbH Product Information, Dec. 2003, XP002556194, p. 18-20 and p. 40-41.

Supplementary European Search Report, App. No. EP 06 77 4168, p. 1-13, completed Nov. 20, 2009 in Munich.

* cited by examiner

*Primary Examiner*—Glenn Caldarola
*Assistant Examiner*—Jim Goloboy
(74) *Attorney, Agent, or Firm*—Morriss O'Bryant Compagni

(57) ABSTRACT

Environmentally safe and compatible fluids that are useful as lubricants, and especially as hydraulic fluids, in mobile machinery are formulated to be non-contaminating when accidentally contacted with surrounding vegetation, and removable from vegetation by simply washing the vegetation with tap water. The fluids of the invention are polyalkylene glycol-based and having an ethylene oxide to propylene oxide ratio of from about 68:32 to about 78:22.

17 Claims, No Drawings

ENVIRONMENTALLY COMPATIBLE HYDRAULIC FLUID

CROSS-REFERENCE TO RELATED APPLICATIONS

This application is a non-provisional application claiming priority to provisional patent application Ser. No. 60/696,060 filed Jul. 1, 2005.

BACKGROUND OF THE INVENTION

1. Field of the Invention

This invention relates to hydraulic fluids for use in machinery and other mechanical systems, and is especially directed to hydraulic fluids for use in machinery that is used in outdoor environments where the unintentional dispersal of hydraulic fluid from such machinery will not harm the surrounding vegetation or the environment.

2. Description of Related Art

It has been a particular problem that machinery used for various outdoor purposes has a tendency to leak hydraulic fluid into the surrounding environment. Conventional petroleum-based hydraulic fluids are well known to have deleterious effects on the environment, such as killing vegetation and polluting the ground and ground water.

Of particular concern in this regard is machinery used to groom golf courses or commercial garden areas, and equipment or machinery used in or near environmentally sensitive areas (e.g., boats, ships, bridges, etc.). When conventional hydraulic fluid from motors, mowers, earth movers and other equipment leaks from the machinery onto the grass or garden areas, or into aquatic environments, the hydraulic fluid contaminates the vegetation and cannot be washed off. The vegetation dies within a short period of time thereafter, and re-seeding or re-planting cannot take place for several weeks to months after contamination. In the interim, the areas where the vegetation died off are unsightly.

In recognition of this problem, other fluid materials have been used as a replacement for conventional petroleum-based hydraulic fluids. For example, vegetable or plant-based oils (i.e., non-petroleum-based oils) have been used in machinery. However, such oils are either unsuitable for use as hydraulic fluids due to the demands of the machinery, and/or such substitute fluids still prove to be damaging to the vegetation because they cannot be easily washed off. Many non-petroleum oils have similar physical properties to petroleum-based products. For example, both have limited solubility in water, both create slicks on water and both form emulsions and sludges. Additionally, non-petroleum oils tend to be persistent and remain in the environment for long periods of time. Thus, non-petroleum or vegetable-based oils are not necessarily compatible with the environment.

Therefore, it would be advantageous to provide a fluid material that is highly suitable for use as hydraulic fluid in machinery that is used in environmentally-sensitive areas such that if the fluid leaks from the machinery, the fluid will be environmentally compatible (i.e., non-destructive to vegetation) and not contaminate and/or kill the vegetation.

BRIEF SUMMARY OF THE INVENTION

In accordance with the present invention, a fluid is provided for use as a lubricant or hydraulic fluid in machinery, the fluid being environmentally friendly to vegetation and the surrounding area. The fluid, if leaked or spilled from the machinery onto vegetation, can be washed off with tap water without any deleterious effects on the vegetation and without contamination of the surrounding environment.

The hydraulic fluid of the present invention comprises a polyalkylene glycol-based fluid of selected viscosity which renders the fluid very suitable for use as a lubricant or hydraulic fluid for machinery (e.g. mobile machinery, such as mowers, earth movers, etc.). The polyalkylene glycol used in the present invention is water soluble, thereby rendering the fluid easily removable from vegetation or other surfaces by simply washing the surface that is exposed to the fluid.

In a particularly suitable embodiment of the invention, the biocompatible fluids of the invention are comprised of one or more water-soluble polyalkylene glycols and the composition has an ethylene oxide to propylene oxide ratio of between about 68:32 and about 78:22. The biocompatible fluids may comprise a mixture of two or more polyalkylene glycols having varying ethylene glycol contents, ethylene oxide to propylene oxide ratios, molecular weights and viscosities.

The fluid of the present invention may further include a third polyalkylene glycol that is preferably polyethylene glycol with a selected viscosity. The biocompatible fluids of the invention may also include at least one surfactant. The fluid of the present invention may further contain other elements, including but not limited to antioxidants, non-corrosion or non-rusting agents, extreme pressure (EP) and antiwear (AW) additives and additional additives of a type used in formulation of lubricants and hydraulic fluids.

DETAILED DESCRIPTION OF THE INVENTION

The environmentally compatible lubrication or hydraulic fluids of the present invention are generally polyalkylene glycol-based, where the polyalkylene glycol is water-soluble. Polyalkylene glycols include a class of compounds comprising polymers of alkylene oxides and mixtures or derivatives of alkylene oxides. Polyalkylene glycols may be low molecular weight or high in molecular weight, and vary widely in viscosity characteristics. The polyalkylene glycols of the present invention may have an ethylene glycol content of between about 50% to about 80%, may be comprised of a selected ethylene oxide to propylene oxide (EO:PO) ratio and have a selected molecular weight and viscosity.

In particular, the water-soluble polyalkylene glycols used in the environmentally compatible fluids of the present invention have varied ethylene oxide to propylene oxide ratios, but the fluid compositions most suitably have an ethylene oxide to propylene oxide ratio of from about 68:32 to about 78:22 in order to render the fluids of the composition most environmentally compatible. The polyalkylene glycols used in the fluid compositions of the invention may have an SUS (Saybolt Universal Seconds) viscosity of from about 50 to about 800, while the compositions may have an SUS viscosity of from about 200 to 240. Further, the polyalkylene glycols used in the present invention may have a molecular weight of from about 200 to about 1700.

In a particularly suitable embodiment of the environmentally compatible fluids of the present invention, the polyalkylene glycol-based component of the fluid may comprise at least two polyalkylene glycols having varied EO:PO ratios, viscosities and molecular weights. While the EO:PO ratio may vary between the one or more polyalkylene glycols mixed in the fluid, the overall ratio of EO:PO of the fluid remains from about 68:32 to about 78:22 to provide optimal biocompatibilty of the fluid. Examples of polyalkylene glycols that may be used in the present invention are poly-glycols made by BASF (Florham Park, N.J.) and identified as the Plurasafe® WS series and Plurasafe® WT series.

In addition to the polyalkylene glycol or glycols, the environmentally compatible fluids may also contain polyethylene glycol (PEG). The PEG used may preferably have a viscosity of from about 89 to 106 SUS at 40° C. An example of a suitable PEG for use in the invention is Pluracol E200 manufactured by BASF. Other PEG's are equally suitable for use, however.

The environmentally compatible fluids may contain additional elements that render the fluid suitable for use as a lubricant or hydraulic fluid in machinery, and which also render the fluid environmentally compatible with the environment. For example, the fluid may contain one or more suitable surfactants. Non-ionic, anionic, amphoteric and cationic surfactants, or mixtures thereof, may be suitable for use. Most suitably, the surfactant may be non-ionic. One exemplar surfactant for use in the environmentally compatible fluids is a poloxamer, such as polyoxypropylene, polyoxyethylene blocked copolymer. An exemplar blocked copolymer that is suitable for use in the invention is either Pluronic L31 or Pluronic R 17R4, both available from BASF.

Additional components for use in the fluids of the invention may include anti-corrosion and/or anti-rusting agents, antioxidants and EP/AW additives, and mixtures thereof. Exemplar anti-corrosion agents may include lanolin, silica-based agents, molybdenum sulfide, boron amine derivatives and benzotriazole or benzotriazole-based compounds. Exemplar antioxidants may include trimethyl quinoline derivatives. Exemplar EP/AW additives may include amine phosphates, thiadiazole derivatives and organosulfur-phosphorous compounds.

A general formula for an environmentally-safe fluid of the present invention is as follows:

EXAMPLE I

| Component | % by weight |
|---|---|
| Polyalkylene glycol | 50-85 |
| Surfactant | 2.0-6.0 |
| Antioxidant | 0.1-2.0 |
| Anti-corrosion or anti-rust agent | 0.01-2.0 |

The following example illustrates a more specific embodiment of the environmentally compatible fluid of the of present invention:

EXAMPLE II

| Component | % by weight |
|---|---|
| Polyalkylene glycol "A" | 50-85 |
| Polyalkylene glycol "B" | 10-35 |
| Polyoxypropylene, polyoxyethylene blocked copolymer | 2.0-6.0 |
| Irganox L57 | 0.1-1.0 |
| Benzotriazole | 0.01-0.1 |
| Amyl acid phosphate | 0.4-2.0 |

where polyalkylene glycol "A" has a minimum ethylene glycol content of 75% and SUS (Saybolt Universal Seconds) viscosity of about 450. An exemplar polyalkylene glycol "A" of this type is available from INEOS Oxide (Zwijndrecht, Belgium) and is identified as PAG 75-H Series. The polyalkylene glycol "B" has an ethylene glycol content of 50% and may preferably have an SUS viscosity of from about 55 to 660. Examples of suitable polyalkylene glycol "B" materials are manufactured by BASF (Florham Park, N.J.) and are in the Plurasafe WS Series. The combined polyalkylene glycol "A" and "B" has an EO/PO ratio of from about 78:22 to about 68:32. The polyoxypropylene, polyoxyethylene blocked copolymer is a difunctional blocked copolymer, non-ionic surfactant. An exemplar product of this class is available from BASF from the Pluronic R series. The Irganox®L57 is an alkylated di-phenyl amine antioxidant propriety to Ciba Chemicals (Basel, Switzerland), and is used in various lubricants. Benzotriazole is an anti-corrosion or anti-rusting agent that is manufactured by various companies, and is available from Cobratec Metal Protection (PMC Specialties Group, Inc., Sun Valley, Calif.) and is sold under the brand name Cobratec®99. Amyl acid phosphate is an exemplar EP additive and is available from many companies, including Polaquima, S.A. DE CV (Mexico City, Mexico).

A further formulation of Example II above may be as follows:

EXAMPLE III

| Component | % by weight |
|---|---|
| Polyalkylene glycol "A" | 70 |
| Polyalkylene glycol "B" | 26 |
| Polyoxypropylene, polyoxyethylene blocked copolymer | 3.24 |
| Irganox L57 | 0.20 |
| Benzotriazole | 0.04 |
| Amyl acid phosphate | 0.5 |

A further embodiment of the environmentally compatible fluids of the present invention is as follows:

EXAMPLE IV

| Component | % by weight |
|---|---|
| Polyalkylene glycol "A" | 58 |
| Polyalkylene glycol "B" | 14 |
| Polyalkylene glycol "C" | 23.95 |
| Polyoxypropylene, polyoxyethylene blocked copolymer | 3. |
| Irganox L57 | 0.36 |
| Irgalube 349 | 0.15 |
| Amyl acid phosphate | 0.50 |
| Benzotriazole | 0.04 |

where polyalkylene glycol "A" has an ethylene glycol content of about 70% and an EO:PO ratio of about 70:30; polyalkylene glycol "B" has an ethylene glycol content of about 50% and an EO:PO ratio of about 50:50; polyalkylene glycol "C" is a polyethylene glycol (PEG) with a viscosity of between 89 and 106 SUS; and Irgalube 349 is an EP/AW additive and corrosion inhibitor manufactured by Ciba Chemicals.

Other exemplar formulations of the environmentally compatible fluids of the present invention are as follows:

EXAMPLE V

| Component | % by weight |
|---|---|
| Polyalkylene glycol "A" | 40 |
| Polyalkylene glycol "B" | 11 |
| Polyalkylene glycol "C" | 45 |
| Polyoxypropylene, polyoxyethylene blocked copolymer | 3.0 |
| Irganox L57 | 0.31 |

-continued

EXAMPLE V

| Component | % by weight |
|---|---|
| Irgalube 349 | 0.15 |
| Amyl acid phosphate | 0.50 |
| Benzotriazole | 0.04 |

where polyalkylene glycol "A" has an EO:PO ratio of 50:50 an SUS viscosity of about 450; polyalkylene glycol "B" has an EO:PO ratio of about 50:50 and an SUS viscosity of about 55; polyalkylene glycol "C" is a PEG having a viscosity of between 89 and about 106 SUS and the blocked copolymer is non-ionic.

EXAMPLE VI

| Component | % by weight |
|---|---|
| Polyalkylene glycol "A" | 60 |
| Polyalkylene glycol "B" | 14 |
| Polyalkylene glycol "C" | 22 |
| Polyoxypropylene, polyoxyethylene blocked copolymer | 3.0 |
| Benzotriazole | 0.04 |
| Irganox L57 | 0.31 |
| Irgalube 349 | 0.15 |
| Amyl acid phosphate | 0.50 |

where polyalkylene glycol "A" has an EO:PO ratio of between about 70:30 and 80:20, and an SUS viscosity of about 450; polyalkylene glycol "B" has an EO:PO ratio of about 50:50 and an SUS viscosity of about 55; polyalkylene glycol "C" is a PEG having a viscosity of between about 89 and 106 SUS and the blocked copolymer is non-ionic.

EXAMPLE VII

| Component | % by weight |
|---|---|
| Polyalkylene glycol "A" | 51 |
| Polyalkylene glycol "B" | 23 |
| Polyalkylene glycol "C" | 22 |
| Polyoxypropylene, polyoxyethylene blocked copolymer | 3.0 |
| Benzotriazole | 0.04 |
| Irganox L57 | 0.31 |
| Irgalube 349 | 0.15 |
| Amyl acid phosphate | 0.50 |

where polyalkylene glycol "A" has an EO:PO ratio of between about 70:30 and 80:20, and an SUS viscosity of about 450; polyalkylene glycol "B" has an EO:PO ratio of about 50:50 and an SUS viscosity of about 100; polyalkylene glycol "C" is a PEG having a viscosity of between about 89 and 106 SUS and the blocked copolymer is non-ionic.

EXAMPLE VIII

| Component | % by weight |
|---|---|
| Polyalkylene glycol "A" | 74 |
| Polyalkylene glycol "B" | 22 |
| Polyoxypropylene, polyoxyethylene blocked copolymer | 3.0 |

-continued

EXAMPLE VIII

| Component | % by weight |
|---|---|
| Benzotriazole | 0.04 |
| Irganox L57 | 0.31 |
| Amyl acid phosphate | 0.65 |

where polyalkylene glycol "A" has an EO:PO ratio of between about 70:30 and 80:20, and an SUS viscosity of about 450; polyalkylene glycol "B" has an EO:PO ratio of about 50:50 and an SUS viscosity of about and the blocked copolymer is non-ionic.

Each of the formulations described above are prepared by mixing the polyalkylene glycol or polyalkylene glycols together with the surfactant or surfactants and stirring the mixture until clear and bright (i.e., not cloudy and free of particulates). The remaining constituents or elements are then added and stirred together. The resulting mixture is heated to a maximum temperature of 50° C. for about 30-60 minutes until any solids, such as may be added in the form of the benzotriazole, are dissolved into solution. Blending of the materials should be continued until a homogeneous clear and bright fluid is achieved.

The environmentally compatible fluids of the present invention may be used as a lubricant for any number of purposes, but is particularly useful as a hydraulic fluid in mobile machinery. When used as a hydraulic fluid in machinery, especially machinery such as mowers and earth movers, and the like, any leaked or accidentally spilled fluid may be easily washed from vegetation with tap water. The vegetation is not contaminated by the fluid and will not be killed by the fluid. The environmentally compatible fluids of the present invention may be adapted to any number of uses as lubricants for any variety of machinery or metal usage. Therefore, reference herein to specific examples and formulations of the invention are by way of example only and not by way of limitation.

What is claimed is:

1. An environmentally compatible lubrication and hydraulic fluid for machinery, comprising:

a polyalkylene glycol base, which is characterized in that the ethylene oxide to propylene oxide ratio of the polyalkylene glycol component of the fluid is from between about 68:32 and 78:22 by weight, and further comprises polyethylene glycol in an amount by weight of between 22.0% and 45.0%.

2. The environmentally compatible lubrication and hydraulic fluid of claim 1 wherein said polyalkylene glycol base is comprised of at least one polyalkylene glycol having an SUS viscosity of between about 55 and about 800 at 40° C.

3. The environmentally compatible lubrication and hydraulic fluid of claim 2 wherein said polyalkylene glycol base is comprised of two polyalkylene glycols having different viscosities and different ethylene glycol content.

4. The environmentally compatible lubrication and hydraulic fluid of claim 1 further comprising at least one surfactant.

5. The environmentally compatible lubrication and hydraulic fluid of claim 4 wherein said at least one surfactant is a polyoxypropylene, polyoxyethylene blocked copolymer.

6. The environmentally compatible lubrication and hydraulic fluid of claim 4 wherein said surfactant is selected from the group consisting of non-ionic, anionic, cationic and amphoteric surfactants, and mixtures thereof.

7. The environmentally compatible lubrication and hydraulic fluid of claim 4 further comprising at least one antioxidant, anti-corrosive or EP/AW additive, or combinations thereof.

8. The environmentally compatible lubrication and hydraulic fluid of claim 7 wherein said fluid contains an EP/AW additive comprising amyl acid phosphate.

9. An environmentally compatible lubrication and hydraulic fluid comprising at least one polyalkylene glycol having an ethylene glycol content of between about 50% to about 80% by weight, at least one surfactant, at least one anti-oxidant and at least one anti-corrosion agent and, polyethylene glycol in an amount by weight of between 22.0% and 45.0%.

10. The environmentally compatible lubrication and hydraulic fluid of claim 9 wherein the ethylene oxide to propylene oxide ratio of said fluid is between about 68:32 and 78:22 by weight.

11. The environmentally compatible lubrication and hydraulic fluid of claim 9 wherein said polyalkylene glycol is present in an amount from about 50% to about 85%.

12. The environmentally compatible lubrication and hydraulic fluid of claim 9 wherein said at least one polyalkylene glycol is two or more polyalkylene glycols having different viscosities and different ethylene glycol contents.

13. An environmentally compatible lubrication and hydraulic fluid comprising:

at least one polyalkylene glycol in an amount by weight of between 50% and 85%;

at least one surfactant in an amount by weight of between 2.0% and 6.0%;

at least one antioxidant in an amount by weight of between 0.1% and 2.0%; and at least one anti-corrosion or anti-rust agent in an amount by weight of between 0.01% and 2.0%; and polyethylene glycol in an amount by weight of between 22.0% and 45.0% wherein the ethylene oxide to propylene oxide ratio of said fluid is between about 68:32 and 78:22 by weight.

14. The environmentally compatible lubrication and hydraulic fluid of claim 13 wherein said at least one polyalkylene glycol has an ethylene glycol content of between about 50% to about 80% by weight.

15. The environmentally compatible lubrication and hydraulic fluid of claim 13 wherein said at least one surfactant is a polyoxypropylene, polyoxyethylene blocked copolymer.

16. The environmentally compatible lubrication and hydraulic fluid of claim 13 further comprising an EP additive in an amount by weight of between about 0.40% and about 2.0%.

17. The environmentally compatible lubrication and hydraulic fluid of claim 16 where said EP additive further comprises amyl acid phosphate.

* * * * *